United States Patent [19]

Carpenter

[11] 4,362,610

[45] Dec. 7, 1982

[54] APPARATUS FOR RECOVERY OF HYDROCARBONS FROM TAR-SANDS

[76] Inventor: Neil L. Carpenter, 175 Nimitz Rd., Kerrville, Tex. 78208

[21] Appl. No.: 151,181

[22] Filed: May 19, 1980

Related U.S. Application Data

[62] Division of Ser. No. 913,629, Jun. 8, 1978, Pat. No. 4,204,923.

[51] Int. Cl.[3] ..... C25B 9/00; C10G 1/00; B01D 43/00

[52] U.S. Cl. ..... 204/263; 196/98; 196/121; 201/19; 204/101; 204/131; 204/136

[58] Field of Search ..... 204/101, 131, 136, 265, 204/242, 263; 196/121, 98; 208/11 R, 11 LE; 201/19; 422/199

[56] References Cited

U.S. PATENT DOCUMENTS

| | | | |
|---|---|---|---|
| 1,930,169 | 10/1933 | Halvorson et al. | 204/131 X |
| 4,043,881 | 8/1977 | Yen et al. | 204/102 |
| 4,043,884 | 8/1977 | Yen et al. | 204/131 |
| 4,043,885 | 8/1977 | Yen et al. | 204/131 |
| 4,045,313 | 8/1977 | Yen et al. | 204/131 |
| 4,065,361 | 12/1977 | Hanson | 196/98 |
| 4,107,022 | 8/1978 | Strempel et al. | 204/265 |
| 4,135,579 | 1/1979 | Rowland et al. | 166/248 |
| 4,213,833 | 7/1980 | Lefevre | 204/98 |

*Primary Examiner*—F. Edmundson
*Attorney, Agent, or Firm*—Darryl M. Springs

[57] ABSTRACT

Apparatus for releasing bitumen components of an earth aggregate by establishing a current flow within an electrolyte contained in a volume of the aggregate which has been isolated from the surrounding earth. The current flow electrochemically acts on the molecular bonds between the bitumen and the aggregate, thus releasing the bitumen. In addition, gases are released and absorbed by the bitumen which, along with the heat produced by passage of the current through the electrolyte, acts to reduce the viscosity of the bitumen. As the viscosity is reduced to the stage where the bitumen is liquid, gravitational action allows the bitumen to separate from the aggregate into a stratum which permits easy removal thereof.

26 Claims, 12 Drawing Figures

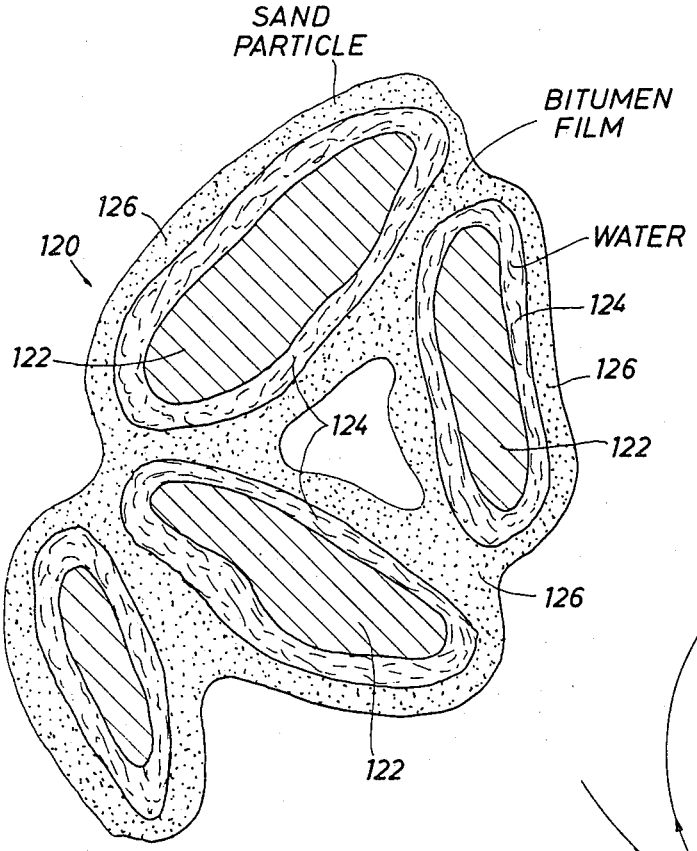
FIG. 4
FIG. 5
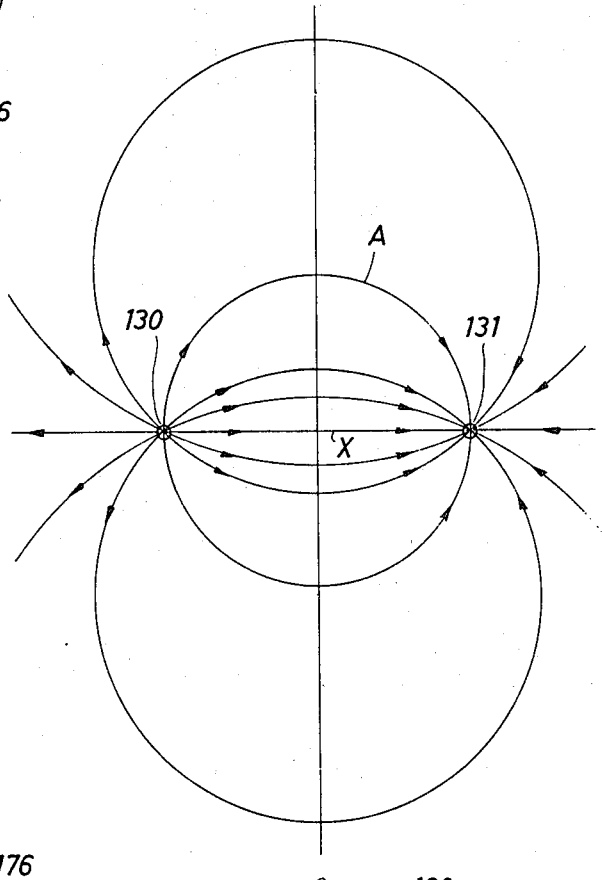
FIG. 6
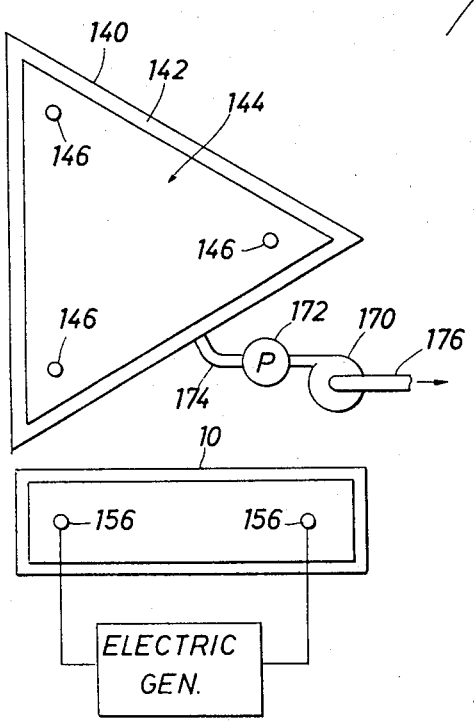
FIG. 7
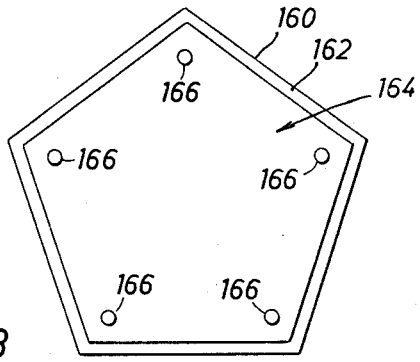
FIG. 8

FIG. 9
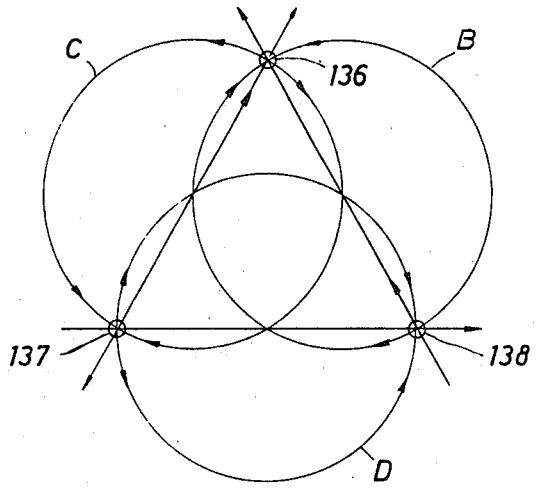
FIG. 10
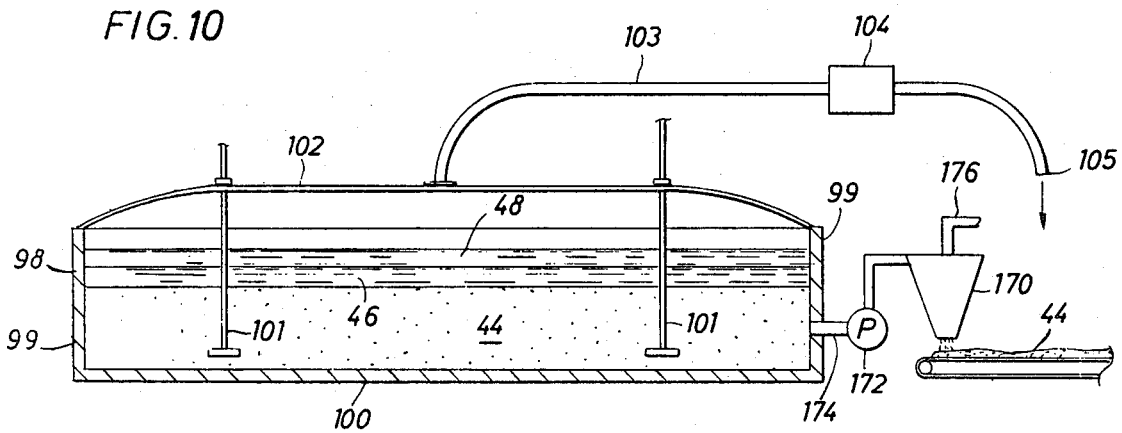
FIG. 12
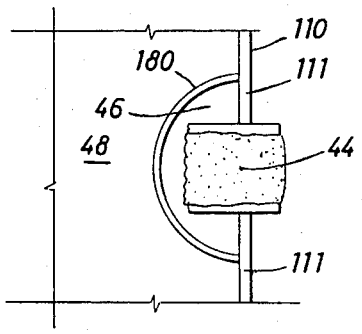
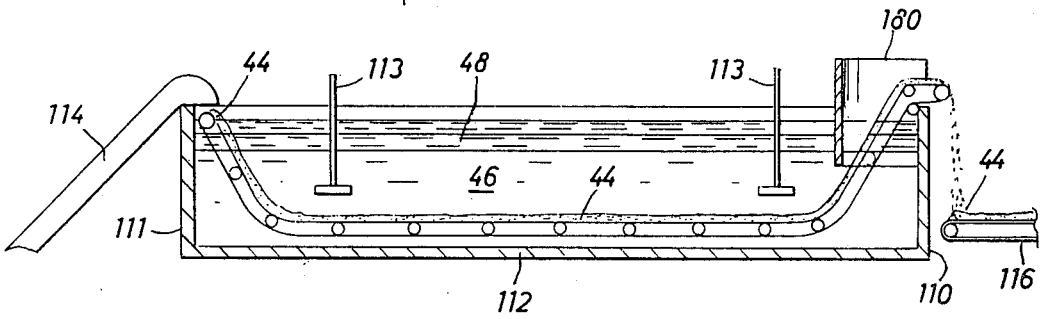
FIG. 11

APPARATUS FOR RECOVERY OF HYDROCARBONS FROM TAR-SANDS

CROSS-REFERENCES TO RELATED APPLICATIONS

This is a division of application Ser. No. 913,629, filed June 8, 1978, now U.S. Pat. No. 4,204,923, issued May 27, 1980.

BACKGROUND OF THE INVENTION

This invention relates to method and apparatus for recovering hydrocarbon constituent elements of an earth aggregate and will particularly relate to methods and apparatus for releasing the hydrocarbon constituent elements of the earth's aggregate from the earth aggregate matrix by establishing an electrical field through the earth aggregate which electrochemically reacts to break the intermolecular bond between the hydrocarbon constituent element and the earth aggregate matrix.

As used herein, "hydrocarbon constituent elements" includes oil, bitumens (such as the asphaltic tars and bitumens found in the Athabasca "tar-sands"), kerogens (such as found in oil shale), and coal, or any other earth aggregate having a fossilized mineral hydrocarbon content. While the preferred embodiments will be described with respect to release of the tar and bitumen contained in the "tar sands", the processes are applicable to recovery of all other hydrocarbon constituents. "Bitumen", as used herein includes all of the fossilized hydrocarbons above-described.

There are numerous deposits of tar and bitumen world-wide which occur on or so near to the surface that it is possible to recover the tar and bitumens by mining on or from the surface. The material recovered is, of course, a mixture of earth material and tar or bitumen which must be separated into the component parts, with the earth materials to be discarded and the bitumens to be saved for further processing and refining.

Such a deposit is found in Alberta Province, Canada, in the Athabasca "tar-sands". The existence of the Athabasca deposits has been known for centuries. Records indicate that the sands were used as a paving material as early as 1915, and first commercial production of bitumen from the sands was achieved in 1930 and the product used as a roofing material. However, notwithstanding the magnitude and problems of the mining operation by itself, the present de-sanding and refining processes are expensive and very complex, involving the use of steam, hot water and corrosive additives. Additionally, Canada has the problem of extremely low temperatures which persist for many months, and perma-frost is nearly always present, compounding the problems of recovering bitumen by conventional thermal means.

The Athabasca tar-sands are located in the northern half of Alberta Province and have been estimated to contain up to 893 billion barrels of bitumen, of which about 350 billion, or 30 to 35%, is recoverable by today's known technology. These sands are a series of quartz sand deposits impregnated with varying amounts of a heavy, highly viscous bitumen. Sands are deposited on an irregular surface of limestone or shale and are generally overlain with overburden. Once the tar-sands have been mined by open pit techniques, bitumen extraction is conventionally accomplished by the hot water process. Although a simple process, it is sometimes extremely difficult to control.

Basic bitumen recovery is accomplished in a very short period of time by mixing the mined tar-sands with water and caustic soda at 180° F. in a slowly rotating drum into which live steam is sprayed below the surface of the slurry formed therein. The tar-sand disintegrates, liberating bitumen from sand and clay particles. The sand is water-wetted in its natural state which allows fairly clean separation of bitumen in the next step. The slurry leaving the conditioning drum is passed over a vibrating screen where clay lumps and rocks, forming a portion of the earth's aggregate, are removed with the slurry delivered into a separation cell, where sand particles settle quickly to the bottom and the bitumen floats to the surface of the cell for recovery. The bitumen is then further processed to completely remove water and other minerals.

The bitumen thus obtained is a highly viscous, tarry, black material having an API gravity of about 9° and contains about 5% sulphur, plus trace amounts of heavy metals such as nickel, vanadium, and iron. With these characteristics, it is not suitable for market use and must be further processed before it can be utilized. Processing is carried out using a "fractionating" or "cracking process" similar to "fractionating" crude oil.

The above-described prior art process for releasing bitumens from the tar-sands requires the use of caustic solutions, thermal heating, and steam generating capability in a geographic area having extremely low temperatures for several months at a time, necessitating complex insulated process plants.

Further, the bitumen recovered is still extremely viscous with poor flow capability that is further compounded by the low temperatures encountered.

The present invention overcomes the deficiencies of the prior art by providing methods and apparatus for releasing the hydrocarbon constituents of an earth aggregate matrix without requiring the use of corrosive additives or live steam processing.

SUMMARY OF THE INVENTION

The present invention may be utilized to aid in the recovery of any hydrocarbon component contained in an earth aggregate matrix. However, without limiting the scope of this invention, and for purposes of illustration, the details of the present invention will be disclosed in context of recovering tar and bitumen from "tar sands" deposits. The problems of the prior art are overcome by providing methods of releasing the bitumen from the water-wetted sands of the mined deposits by establishing an electrical current flow within the mined earth aggregate through a plurality of spaced electrodes extending into a preselected volume of the aggregate, electrically insulated from the earth, for establishing a zone of electrochemical activity therein. The resulting electrochemical reactions with constitutent elements of the earth's formation, such as the connate water and the bitumen result in the generation of large quantities of gas and an elevation of the temperature of the earth aggregate. The elevated temperature aids in the released gases being absorbed into the bitumen thereby reducing gravity and viscosity.

The instant method employs an electrical current and an electrolyte which, in tar-sands, is primarily the saline water normally present, at least in connate form, in the tar-sand matrix. However, the term "electrolyte" is intended to include all forms of a liquid electrolyte containing any desired chemicals, solvents, or other ingredients useful in separating the tar from its sand-grain matrix. It has long been known that saline water is an electrolyte, and that the passage of electrical current through such a solution causes an elevation of temperature and that the resistivity of the solution to current flow declines as temperature increases. Only recently discovered, is the fact that the combination of passing alternating current through saline water is an efficient producer of free hydrogen gas; and when a hydrocarbon substance is added to the mixture, carbon dioxide and hydrocarbon gases are also produced. (See U.S. Pat. No. 4,037,655-Carpenter).

Another phenomenen is an almost instant separation of the tars or bituminous substances from the earth materials. Since the connate water film envelope interspaced between the individual grains of the earth material and the bitumen is saline and therefore conductive, current passes through the combined materials along myriad connate water film paths. Gases are generated as abovedescribed and heating takes place.

Apparatus for accomplishing the above-described method is, in one preferred embodiment, comprised of a holding tank for receiving and supporting the tar-sands to be treated, a plurality of electrodes positioned to contact the tar-sands, a source of electrical current connected to each of the electrodes for establishing an electrical current path through the electrolyte of the tar-sands being treated, and means of adding tar-sands to be treated and a means of removing sand from which the bitumen has been released, and a means for recovering the released hydrocarbon constituents.

Accordingly, it is a primary feature of the present invention to provide method and apparatus for recovering hydrocarbon constituents from an earth aggregate matrix without requiring the use of steam processing.

Another feature of the present invention is to provide method and apparatus for enhancing the flow characteristics of the bitumen recovered from the earth aggregate matrix by lowering the viscosity and specific gravity of the bitumen.

Yet another feature of the present invention is to provide method and apparatus for establishing an electrical current in the earth aggregate matrix for generating hydrocarbon gases of which all or part would be absorbed into the released hydrocarbon constituent thereby reducing gravity and viscosity.

Another feature of the present invention is to provide method and apparatus for establishing an electrical current in the earth aggregate matrix for causing electrochemical separation of the bitumen from the sand grains of the aggregate.

These and other features and advantages of the present invention will become apparent from the following detailed description when considered in conjunction with the accompanying drawings.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope when the invention may admit to further equally effective embodiments.

In the drawings:

FIG. 4 is a cross-sectional view of the earth aggregate matrix of a typical "tar-sand".

FIG. 5 is a diagrammatic view illustrating horizontal distribution between a pair of electrodes desposed in an established volume of a hydrocarbon bearing earth aggregate.

FIG. 6 is a top view of an earth aggregate processing tank for use with three electrodes.

FIG. 7 is a top view of an earth aggregate processing tank for use with two electrodes.

FIG. 8 is a top view of an earth aggregate processing tank of the present invention for use with multiple electrodes.

FIG. 9 is a diagrammatic view illustrating horizontal alternating current distribution between three electrodes utilizing three-phase alternating current in an established volume of a hydro-carbon bearing earth aggregate;

FIG. 10 is a cross-sectional view of another embodiment of the apparatus depicting the use of a sealed cover for recovery of gases generated by passage of electric current through the earth aggregate.

FIG. 11 is a cross-sectional view of yet another embodiment of the invention depicting use of a conveyor means for continuously introducing earth aggregate into the electrical current path developed by the electrodes.

FIG. 12 is an enlarged partial top view of the shroud 180 around conveyor 115 as shown in FIG. 11.

DETAILED DESCRIPTION OF THE PREFERRED EMBODIMENTS

Figure 1:
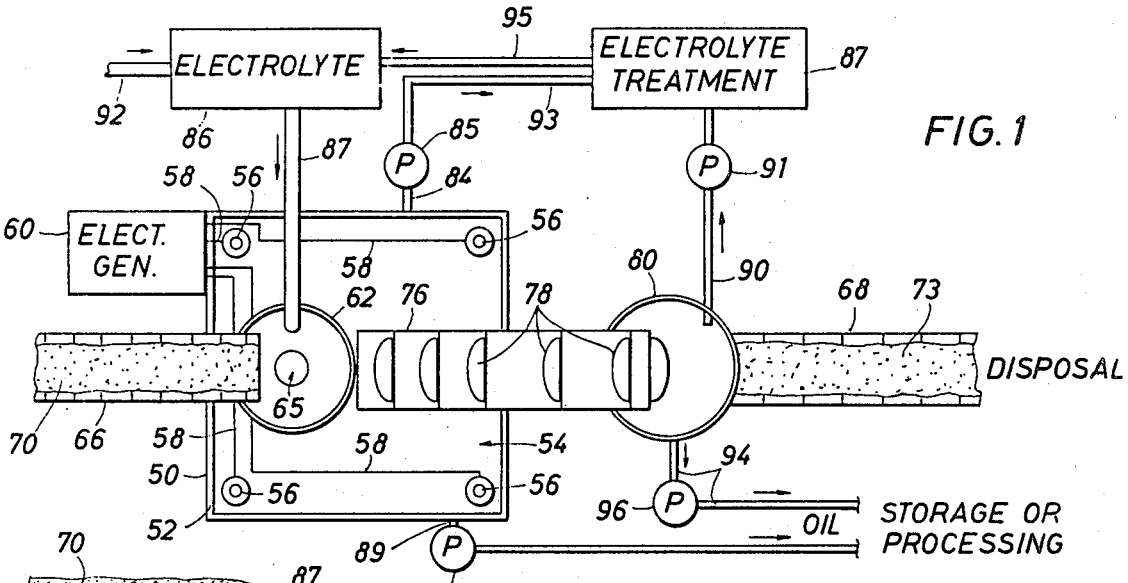
FIG. 1 is a top view of a earth aggregate processing system according to one embodiment of the present invention.

Without limiting the scope of this invention, and for purposes of illustration, the details of the present invention will be disclosed in context of recovering tar and bitumens contained in the so-called "tar-sands" such as found near the Athabasca River of Alberta Province, Canada. The instant invention provides for release of the tar and bitumen contained in the "tar-sands" and for the generation of hydrogen and hydrocarbon gases which aid in reducing the viscosity of the tar and bitumen released, thus aiding in the recovery thereof. This is achieved by applying electrical current to the saline water normally present (at least in connate form) in the tar sand matrix. It has long been known that saline water is an electrolyte, and that passing electrical current through such a solution causes an elevation of temperature and that the resistivity of the solution to current flow declines as temperature increases. The action of the electrical current on the saline water produces free hydrogen gas, and when a hydrocarbon substance is mixed with the electrolyte, carbon dioxide and hydrocarbon gases are also produced, which all or in part could be absorbed into the bitumen thereby reducing its gravity and viscosity. This result is achieved by applying an electrical current to an established volume of the mined tar-sands insulated from the earth, and electrodes formed of aluminum or a similar material characterized by a lower resistivity than steel.

The current flowing through the circuit can be controlled by varying the supply voltage potential or by varying the resistivity of the water. Power dissipated in the water, acting as a resistor, is manifested in the form of thermal energy or heat which is in turn distributed to the earth aggregate 44. As the salt water temperature rises, the resistance of the salt water declines, thus allowing a greater current to flow through the material 44. Thus, the action of the electrical current passing through the tar-sands will heat the earth aggregate due to the resistance of the salt water, and, because of the electrochemical reaction in the rising heat within the tar-sands, will release the hydrocarbon components of the tar-sands. As the generated heat increases, increasing the temperature in the tar-sands, and releasing more of the trapped bitumen, the elevating temperature will reduce the viscosity of the released bitumens. Additionally, the action of the current passing through the salt water will generate free hydrogen and $CO_2$ as well as hydrocarbon gases.

Mass spectrometer analyses show that a pure saline solution will produce as much as 71% free hydrogen and only 5% oxygen, while a solution consisting one-half of the saline solution and one-half low gravity bitumens, such as low gravity crude oil, produces 32% hydrogen, 1.48% oxygen, 20% carbon dioxide and a combination of methane, ethanes and butanes equal to 21%. This indicates an exchange of carbon molecules for hydrogen molecules, and a probable absorption of a part of the hydrogen by the bitumen material. It is significant that the gas generation reactions occur (though not in the same percentages for any gas measured, or the same combination of percentages) over a wide range of temperatures, generally above 185° F., up to but not exceeding the boiling point of the saline solution. The absorption of the hydrogen and other gases, as well as the elevated temperature, aids in reducing the viscosity of the released bitumens.

To summarize, the electrochemical action of the electrical current will produce at least the following known phenomena:

1. Reduction in the viscosity and specific gravity of the bitumen in the tar-sands, thus enhancing the flow characteristics of the bitumen;
2. Generation of large volumes of free gas in the tar-sands due to electrochemical action with the bitumen and connate water in the tar-sands;
3. Release of the bitumens and connate water from the earth aggregate matrix; and
4. Production of heat in the tar-sand earth aggregate matrix in the area traversed by the current;
5. Dissolve sulphur contained in the tar and bitumen by the electrolyte.

It is well known that the apparent specific gravity and viscosity of bitumens will decrease with a corresponding increase in the temperature of the bitumen, while the API gravity increases. In addition, the passing of an alternating current through the tar sands apparently causes electrochemical actions that change the chemical properties of the bitumens to decrease the specific gravity and viscosity of the bitumen and increase the API gravity beyond a degree that can be attributed to heat alone.

The source of the gases generated in the aggregate and the reasons for its production are not fully understood at this time. But several explanations based on laboratory experiments may be offered. They are:

(a) production of free hydrogen and oxygen by AC disassociation of the salt water contained in the aggregate;
(b) chemical action of hydroxides, resulting from AC disassociation of the salt water, acting on the bitumen in the aggregate;
(c) direct molecular conversion of large bitumen molecules to hydrocarbon gas molecules such as methane;
(d) release of gas molecules in solution in the salt water present in the aggregate;
(e) release of solution gases by heat, such as methane and carbon dioxide, present in the bitumen;
(f) release of solution gases in the bitumen by the "stripping" action of free hydrogen and oxygen and any steam produced in the aggregate as a result of heat;
(g) formation of hydrocarbon gases as a result of hydrocracking and subsequent hydrogenation of the bitumen by free hydrogen gases;
(h) formation of carbon dioxide by the action of nascent oxygen reacting with the carbon molecules in the bitumen; and
(i) formation of carbon dioxide by action of nascent oxygen combining with carbonates commonly present in the salt water on the aggregate matrix in some hydrocarbon containing aggregates.

It is also well known that heating of bitumen and tar in the aggregate will release solution gases. Thus, in the heated areas of the aggregate, solution gases such as methane gas and carbon dioxide dissolved in the bitumen will be released. But the large release of gases encountered in the results of lab tests cannot be accounted for solely on the basis of release of solution gas by thermal action.

Laboratory tests have shown that a bituminous compound and salt water mixture will produce, under the action of an AC electrical current, large volumes of free hydrogen and carbon dioxide, and lesser volumes of free oxygen, methane, ethane, propane, and butanes plus. The free hydrogen and oxygen are the result of AC disassociation of the salt water, which will be hereinafter discussed in greater detail. With nascent oxygen generated by such AC disassociation of water, the presence of the carbon dioxide could be the result of (h) or (i) above. Some of the hydrocarbon gases may be the result of hydrocracking and hydrogenation of the bitumen by free or nascent hydrogen as described in (g) above.

In direct molecular conversion of a hydrocarbon molecule chain to form molecules of hydrocarbons that remains in liquid form and others that take the form of gaseous hydrocarbons, the AC electrical current is acting directly on the hydrocarbon molecules to cause the conversion or breakdown for reasons not presently fully appreciated. But this phenomena could account for a substantial part of the hydrocarbon gases produced in the earth aggregate.

Methane is slightly soluble in water, due to a slight attraction between methane molecules and water molecules. However, it is known that carbonates and bicarbonates present in the water will increase the solubility of methane in the water. In the aggregate matrix, the connate water molecules collect around methane molecules to form a cagelike film held together by hydrogen bonds. Since the water molecules have an unusually causing an electrochemical action as will be hereinafter further described.

It is apparent that various types of tar-sands and other bitumen containing material will contain varying amounts of connate water. Thus, if the bitumen being processed is found to contain low levels of connate water, it may be desirable to enhance recovery by adding an additional electrolyte. The electrolyte may be a caustic, such as caustic soda, or it may be a wetting agent, such as tri-sodium phosphate or any other suitable chemical that will have desirable electrolytic characteristics.

Additionally, climatic conditions may require that solvents, such as diesel oil, be added to the released bitumen. The above-mentioned additives will act to thin the bitumen, aiding in the movement to final refinement, particularly where a low temperature environment is encountered.

While circumstances may require that the above-mentioned electrolyte or solvents be added to the bitumen bearing aggregate and such additives are contemplated within the scope of the invention, the preferred embodiment hereinafter disclosed will, for simplicity be directed to an electrolyte in the form of connate saline water, or a saline water solution added to the aggregate during processing.

One of the prior art problems in recovering bitumen from tar-sands has been that in a steam treatment process, the tar sands are treated with fresh water resulting from the steam, and the tarry bitumen after has a specific gravity that is higher than that of the fresh water, and therefore, the bitumen will not float on the surface of the water, thus making recovery more difficult. However, in the instant process, use of a saline electrolyte raises the specific gravity of the water sufficiently to overcome this problem and cause the tarry bitumen to float on the surface of the water to enhance separation and recovery. Of course, other suitable chemicals or materials may be added to achieve the same purpose.

Figure 3:
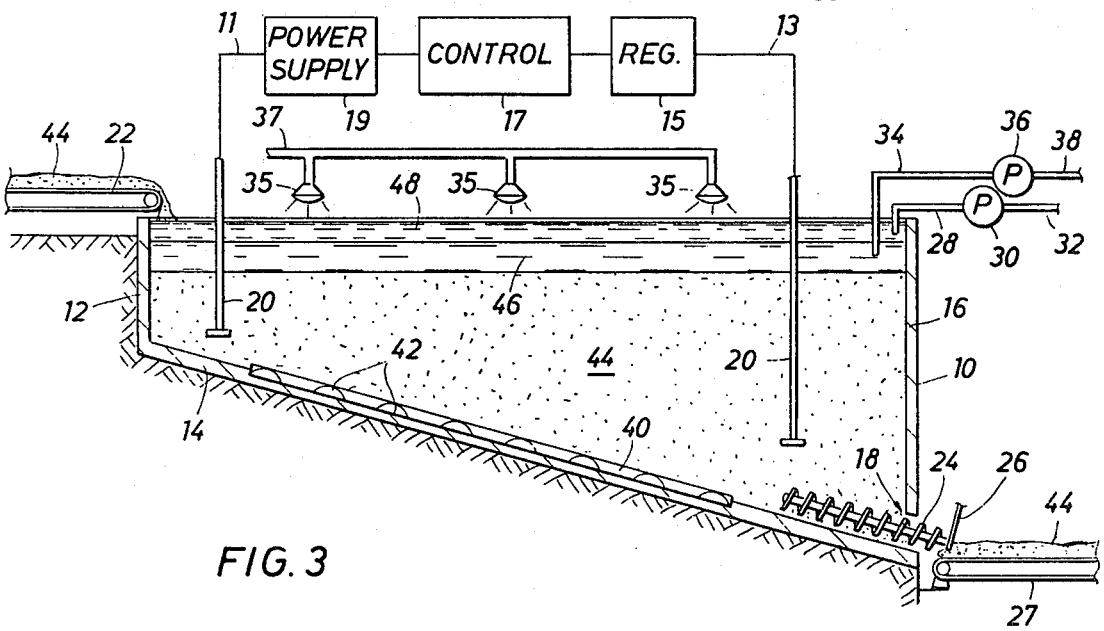
FIG. 3 is a cross-sectional view illustrating the pair of electrodes positioned in a tank designed to receive to hydrocarbon bearing earth aggregate for passing electric current therethrough in accordance with one embodiment of the present invention.

Referring now to FIG. 3, there may be seen a simplified diagrammatic illustration of a portion of a tank 10 shown disposed in the earth and formed of an electrical insulating material such as concrete or the like. Tank 10 has vertical walls 12 and 16 and a downwardly sloping bottom 14. As will be hereinafter explained, the actual geometric form of tank 10 can be a function of the number of electrodes utilized in the practice of the invention as will be hereinafter further explained.

Still referring to FIG. 3, a pair of electrodes 20 are shown positioned in the interior of tank 10. The upper ends of both electrodes 20 are connected by suitable leads 11 and 13, to suitable regulating 15 and control equipment 17 to an electrical power supply 19. The size and capacity of the power supply 19 for generating electrical current will be determined by the volume of material and the resistance of the electrolyte contained by tank 10. Additionally, the power supply 19 and interconnections to electrodes 20 must be fully insulated from the earth to isolate the electrical current path within tank 10 as will be hereinafter explained.

Additionally, the tank 10 of FIG. 3 is shown to include a standard conveyor assembly 22 utilized to feed the earth aggregate to the interior of tank 10. A discharge auger 24 is positioned in an opening 18 formed in the lower extremity of wall 16 and extends from the interior of tank 10 outward, terminating above a discharge conveyor assembly 27. Auger 24 is powered by a motor (not shown) rotating a drive belt 26 which rotates the auger in a direction to remove material from the interior of tank 10 to the exterior, allowing the removed material to fall on the discharge conveyor belt assembly 27 for removal away from tank 10.

During operation, mined tar-sand 44 is conveyed from a mining operation (not shown) to the interior of tank 10 by conveyor 22 until the tank is substantially full. The downwardly sloping base 14 allows the sand to slide to fill the tank adjacent vertical wall 16 first. When the tank is filled, an electric current flow is established between the electrodes 20 through the tar sand 44. As will be hereinafter explained, bitumen contained in the tar-sand and water are heated and released and rise above the sand to form a water layer 46 and an overlying bitumen layer 48. The sand, which has been depleted of the water and tar, is then withdrawn from the interior of tank 10 by auger 24 and from the vicinity of tank 10 by discharge conveyor assembly 27. Additionally, and to aid transfer of the incoming tar-sand 44 from adjacent vertical wall 12 along downwardly sloping base 14 to vertical wall 16, an agitator assembly 40 may be provided and, for example, may comprise a plurality of spaced electro-mechanical ultrasonic agitators 42, although other agitating means may be employed. The heated bitumen may then be removed from tank 10 by means of pump 30 withdrawing the fluid bitumen from tank 10 through intake 28 for pumping to a suitable storage tank or other processing equipment 32 (not shown). Similarly, water 46 may be removed by pump 36 withdrawing water through intake 34 for disposal or storage in tank 38 (not shown).

In tar-sands, the hydrocarbon bearing earth aggregate matrix is "water-wetted" as shown in FIG. 5, meaning that highly conductive salt water is ordinarily associated with the tar-sand formations. Such salt water, called "connate" salt water, is distributed throughout the tar-sands 120 as a film 124 about the individual sand grains 122 which, in turn attracts a film of bitumen 126. Although the bitumen is a poor conductor of electricity, the connate salt water distributed throughout the tar-sands about the "water-wetted" sand grains is capable of transmitting an electric current.

The electrical current may conveniently be a single-phase AC sourse of electric power. In the preferred embodiment of the present invention, a poly-phase alternating current power 19 is connected to electrodes 20 through control 17 and regulator 15, the alternating current will flow through a series path from one electrode 20, in contact with the tar-sand, to the remaining electrodes 20. Designating the resistance of one electrode 20 as $R_a$, and the resistance of the remaining electrode as $R_b$, and the resistance of the salt water in the tar-sands 44 designated as $R_w$, the current flowing in the above-described path can be expressed mathematically as:

$$I = \frac{V}{R_a + R_b + R_w} \quad (1)$$

when the power dissipated in the water will, of course, be equal to $I_2 R_w$. It will therefore be apparent that it is very desirable that the resistance of the electrolyte providing a path between the electrodes 20 have a high resistance as compared to the total series resistance of the electrodes, $R_a + R_b$. In fact, to achive this relationship in some instances, it may be desirable to utilize large dipole moment (1.8 Debye units), the molecules rotate in response to an impressed electric field. The exposed hydrogen protons of the water molecules turn toward the negative potential of the electrical field. This rotation of the water molecules in response to an electrical field can break the hydrogen bonds between the water molecules, thus releasing the methane molecule. This chemical action of releasing the methane molecules trapped in the connate salt water would also generate heat, which indicates that a heating effect due to chemical reactions also takes place in the aggregate traversed by the current.

AC DISASSOCIATION OF WATER

In a conventional 60-cycle alternating current (AC), the applied emf fluctuates from plus (+) to minus (−) polarity 60 times per second, varying as the well-known sine wave. Thus, during half a cycle, one hundred-twentieth of a second, the voltage rises from zero to a peak value then falls again to zero. During the next half cycle the voltage becomes negative, reaches a minimum, numerically equal to the positive peak, then rises back to zero and repeats itself in the next cycle. This alternation of polarity results in a back-and-forth motion of the electrons in the lead wires to the electrodes. Thus, the conduction electrons in the wire only move minute distances back and forth. Nevertheless, this vibratory motion constitutes the alternating current. This oscillation causes the electrodes to become "positive" or "negative" depending on whether the electrons in the connecting wire are moving away or toward the electrode, respectively. The motion of electrons away from one electrode corresponds to a motion of electrons toward the other electrode. Hence the electrodes alternate in polarity from "positive" to "negative" sixty times per second.

This alternation of electrode polarity results in an alternating attraction and repulsion of the + ions in the electrolyte. In a salt water solution there are $Na^+$ and $Cl^{31}$ ions. Some of the $Na^+$ ions drawn to the negative electrode are neutralized to Na atoms during one half cycle. The next half cycle, when the electrode is positive, the $Na^+$ ions are repelled and some of the $Cl^-$ ions are neutralized to Cl atoms by the removal of electrons. The chemical reaction at the electrodes during AC disassociation of salt solutions thus depends on the interaction of free sodium and chlorine atoms and the adjacent atoms both in the electrolyte and in the electrodes.

Basic studies of these electrode interactions are reported mainly in the literature of fifty years ago. These observations were related to such diverse research as the behavior of bacteria under the action of electric fields, the generation of explosive gases in electric boilers and the influence of alternating currents on the corrosion of underground steel pipes and cables. These papers establish several basic principles of "AC electrolysis":

(1) There is a critical alternating current density, $j_o$, in amperes/cm$^2$ below which no disassociation of the water molecule into free $H_2$ and O occurs at the electrodes;

(2) above jo, AC disassociation of water into free $H_2$ and O generally follows the Faraday law of DC electrolysis;

(3) The value of $j_o$ depends on the composition of the electrolyte and of the electrodes. It is attributed to the capacity of the electrodes to store the products of electrolysis which in turn depend on the nature and condition of the electrode surface and the type of electrolyte present;

(4) In some experiments it was observed that an excess of free hydrogen was generated over stoichiometric volumes of oxygen in the evolved gases; and (5) It was also reported that generation of gas was accomplished by the disassociation of water due to arcing between the electrodes and the electrolyte. Under certain conditions it was found that the decomposition of water by arcing was more than five times that by electrolytic disassociation with the same current and over the same time period.

The most pertinent papers found in this field and which relate to the above findings are:

1. Shipley, "The Alternating Current Electrolysis of Water", *Canadian Journal of Research,* Vol. 1, pp. 305–358 (1929);
2. Shipley and Goodeve, "The Law of Alternating Current Electrolysis and the Electrolytic Capacity of Metallic Electrodes", *Trans. Am. Electrochem. Soc.,* Vol. 5, 375–402 (1927);
3. Marsh, "On Alternating Current Electrolysis", *Proc. Royal Soc.,* London, Vol. 97A, 124–144 (1920).

Marsh related the quantity of evolved gases to the current density of the AC current in the electrode. He suggested that some of the gas liberated in any half cycle is retained at the same electrode and is then attacked by gas liberated in the succeeding half cycle and the reformation of water. He also noted that the total volume of gases liberated was less than that predicted on a theoretical basis.

Shipley and Goodeve discuss the generation of gases by AC electrolysis as the result of the actions of an alternating current being a series of equal and opposite direct currents which should liberate on the electrodes its equivalent of hydrogen and oxygen according to Faraday's law. One ampere of DC current in one minute produces 10.4 cc. of electrolytic gas at standard conditions, in accordance with Faraday's law. Therefore, one ampere of an AC current should theoretically produce 9.42 cc. per minute. One electrode should produce 4.71 cc. of electrolytic gas per minute. This can be represented by the equation:

$$R=4.71\ I_F \qquad (2)$$

In all cases in the research by Shipley and Goodeve, it was found that the AC current produced less gas than that required by Faraday's law. The rate of evolution was found:

(1) to be a function of the current density, when the current density was maintained uniform over the surface of the electrode;

(2) to increase in direct relation with the increasing current density above the critical point; and (3) to follow with few departures a straight line curve parallel to Faraday's law.

The critical point was found to depend on the nature of the metal electrode, the coating on the surface of the electrode and the temperature of the electrode and electrolyte.

The data from Shipley and Goodeve reflected the yield of gas from soft iron electrodes as 10 cc/cm$^2$ and dropped to zero below current densities of 3.8 ampere/cm$^2$. Above this critical current density the increase in gas yield was about 4 cc./minute for unit current increase in fair agreement with the 4.7 cc./minute required by Faraday's law. It was also noted that the yield and critical current density of steel is nearly the same as for soft iron.

Although the prior research papers speak of the phenomenon of "AC electrolysis" of water, Applicant prefers to define the phenomena as "AC disassociation" of water. Accordingly, the term "AC disassociation" of water, as used herein, includes the classical definition of "electrolysis" for decomposition of water due to polar effects of the electrodes on charged electrolyte ions, but further includes all other physical and chemical phenomena effecting an electrolyte due to the physical and electrical phenomena associated with an AC current. In the classical electrolysis of an electrolyte comprising sodium chloride and water, two volumes of hydrogen is liberated to one volume of oxygen, and free chlorine gas is liberated, while in all field and lab tests to data, Applicant has yet to detect the release of chlorine gas, and the ratio of free hydrogen to oxygen gases liberated is always higher than predicted. Although the lower ratio of hydrogen to oxygen gases has been found in earlier lab work, no definitive explanation has yet been offered as to what chemical reactions prevent the liberation of chlorine gas. Further, the effects of other alternating current phenomena such as extremely low and high frequency effects, AC electrical field strengths, AC current density in microscopic pore spaces, AC current effects in conductive earth formation mediums such as shales and AC magnetic field density effects are not believed predictable under the classical "electrolysis" theories.

By a classical "electrolysis" theory is meant a definition such as the following:

Electrolysis:

"decomposition by means of an electric current; the compound is split into positive and negative ions which migrate to and collect at the negative and positive electrodes"

*Condensed Chemical Dictionary*, 6th Ed., Reinhold Publishing Corp. (1961). Such a definition is obviously based on traditional DC decomposition theory, but fails to take into account all other physical and chemical effects that may be taking place due to the special effects peculiarly associated with AC current theory.

DISTRIBUTED GENERATION OF GASES

Experimentation using the methods which are the subject of the present invention have yielded some results which may be at least partly explained by the AC disassociation theory of water.

Assuming that a first current is chosen where gas does not evolve from the tar-sand/electrode interface, the current density is determined by the surface area of the electrode and thereafter by the relative surface area of the electrolyte.

As hereinabove explained, the naturally occurring connate water in the tar-sand aggregate is confined to a capillary film 124 surrounding the sand grains 122 of the tar-sands forming what is referred to as "water-wetted" sands. Accordingly, if a slice were made through the tank 10, a relatively small surface area of electrolyte per unit area of tar-sand would be available in the tank compared to the surface area of electrolyte available at the electrode/tar-sand interface. This can result in a higher current density in the tar-sand aggregate electrolyte remote from the electrodes at a given operating current level than at the electrode/tar-sand interface. Thus, gases can be evolving throughout the tar-sand aggregate of tank 10 and not just at the tar-sand electrode interface.

It has also been observed, however, in field tests involving oil formations, that larger volumes of gases evolve in the formation than are predicted solely by Faraday's law of electrolysis. Thus, a second disassociation mechanism encompassed within the hereinabove "AC disassociation" definition may be taking place. The electrolyte, generally a saline solution, has a "negative" temperature coefficient of conductivity where the conductivity actually increases with temperature. It can be seen that the electrical resistance of the electrolyte in the tar-sand will result in heating of the electrolyte as current passes therethrough. The heated electrolyte has a lower resistance and a higher current will result for a given voltage gradient. Since power dissipation is proportional to the current at a given voltage, it is clear that a localized instability can be produced.

To further explain the phenomena of gas generation in the tar-sand aggregate or oil producing formations, especially in attempting to explain the larger volumes of hydrogen and oxygen that can be produced over and above that predicted by Faraday's Law, another phenomenological theory has been developed. The specific assumption underlying this theory is that the action of AC in electrolytes can cause pores or bubbles in which electrolytic gases are released and in which electrochemical reactions can occur through arcing. It is often useful in mathematical physics to assume a particular geometry in order to derive the applicable equations. Later there is considerable simplification if the choice of geometry is not necessary. Such is the case in this theory of gas distribution.

Consider a cylindrical pore in the bitumen bearing matrix containing salt water of resistivity (R) of $\rho$ ohm-meter and density D kg/m$^3$ and specific heat $\sigma$ joule/kg °oC. D=mass/volume−M/V in kg/m$^3$. The rate of heating can be expressed as:

$$dQ/dt = i^2R \tag{3}$$

where:

i=current in amperes

R=resistance in ohms

Ohm's law can be expressed as:

$$i = v/R \tag{4}$$

where:

$v$=voltage in volts

Electrical heating (P) can be expressed in the following equation:

$$P = i^2R \tag{5}$$

Substituting equation (4) in equation (5) results in:

$$P = \frac{v^2}{\frac{R^2}{R}} = V^2/R \tag{6}$$

The heat added to the pore can be expressed as:

$$dQ = M\sigma dt \tag{7}$$

and substituting from equation (3)

$$dQ/dT - M\sigma dT/dT \tag{8}$$

and $$dT/dT = i^2R/M\sigma \quad (9)$$

and substituting from (6)

$$dT/dT - v^2/RM \quad (10)$$

The mass (M) of salt water in the pore can be expressed as:

$$M = DV \quad (11)$$

where:

D = mass/volume

V = volume and the mass of a cylindrical pore would be expressed as:

$$M = DL\ (\pi d^2/4) \quad (12)$$

where:

$$V - L\ (\pi d^2/4 \quad (13)$$

and where:

L = length of pore = 0.01 meter = 1 cm d = diameter of pore = 0.01 meter = 1 cm

Using the definitions above for R, R can be expressed as:

$$R = \rho L/(\pi d^2/4) \quad (14)$$

Substituting values expressed in equations (13) and (14) into equation (10) the resulting equation is:

$$dT/dT = v^2/\rho\sigma DL^2 \quad (15)$$

Thus the rate of heating as expressed in equation (15) is independent of the diameter of the pore for a given potential gradient [v/L (length of pore)] and is inversely proportional to the product $\rho\sigma$D.

Assuming typical values for connate water of earth aggregate 44, the product $\rho\sigma$D can be expressed as:

$$\rho\sigma D - 10^{-4}(\text{ohm-m}) \times 10^3 \text{kg/m}^3 \times 10^3 \text{ joule/kg°C.} \quad (16)$$

The dimensions of voltage gradient are volts/meter, hence substituting into equation (15)

$$\begin{aligned} dT/dT &= \text{voltage gradient}^2/\rho\sigma D \\ &= (\text{volts/m})^2\ (M^2\ \text{°C./joule-ohm}) \\ &= \text{joule/sec} \end{aligned}$$

Therefore $$dT/dT = (\text{voltage gradient}\ ^2/400)\text{°C./sec} \quad (17)$$

Once the temperature of a particular pore exceeds that of the surrounding salt solution, the localized pore temperature tends to accelerate because of the negative temperature coefficient of conductivity. Thus, once a pore begins to heat it becomes more conductive and provides a preferred path for the current. Since the heating is proportional to the square of the current and the first power of the resistivity (inverse of conductivity), the rate of heating increases until the boiling point is reached and localized arcing occurs. Localized arcing appears to be an unstable condition, both at the electrodes and in the electrolyte, from visual observations in laboratory tests. It seems likely that this is a form of the familiar Taylor instability that is prevalent in plasma physics. The net result is that the arc is quickly quenched by the inflow of cooler electrolyte with a consequent shifting of the localized higher current to another area where the process is repeated. In this way the arcing action can spread over a large volume of the tar-sands giving a wide distribution of electrochemical action for producing gases.

It is theorized that the instability, hereinabove described, will finally result in very localized areas of steam formation where sufficient heating of the electrolyte occurs. The ionization potential for steam is significantly less than for water, such that the existing voltage gradients within the formation structure could ionize the steam with a resulting arc through the steam. The high temperatures produced by the arc would be sufficient to disassociate the water molecules in the vapor and produce large quantities of gases such as hydrogen and oxygen, in addition to gases evolved directly by AC disassociation.

The formation of steam would result in a sudden increase in electrical resistance in the localized area and the arc would discharge any stored charge so that a much lower electrical current would not be obtained. Accordingly, the steam could then condense until another unstable cycle begins.

In summary, the disclosed apparatus and method of releasing bitumen from an earth aggregate serve to produce the following phenomena:

(1) the critical AC current density for the production of gases due to AC disassociation is exceeded between the electrodes;

(2) the AC current density at the interface between the electrodes and the earth aggregate electrolyte is at or below the critical value for gas generation:

(3) the potential gradient within the aggregate volume is sufficiently high and is spatially distributed to produce electrochemical action throughout a large volume of aggregate between the electrodes; and (4) the electrochemical action generates gases, including some low molecular weight hydrocarbons, breaks physical and chemical bonds binding the bitumen to the aggregate matrix, and decreases the viscosity and specific gravity of the bitumen.

As hereinbefore mentioned, laboratory experiments have shown that bitumen will be released from sand grains under the influence of an AC current. The reasons for this release of the bitumen and connate water from the sand grains in the presence of an AC current are not fully understood but may be the result of the rotation of the water molecules in the connate water under influence of the electric field, as hereinabove described, that break hydrogen bonds with the bitumen film that coats the connate water film that surrounds the sand grains of the earth aggregate matrix.

Further, the release of methane molecules from the connate salt water, as above described, would also dislodge bitumen molecules from the residual bitumen film that coats the connate water film surface, thus dislodging both the methane molecules and the bitumen molecules to form gas for reacting with the released bitumen and for freeing bitumen molecules that will tend to move, because of gravitational forces, to form a stratum of bitumen above the aggregate. The water freed of the aggregate matrix would also tend to gravitate above the aggregate to form a second stratum between the bitumen stratum and the aggregate. Such a release of bitumen from the aggregate matrix, and gravitation to a stratum above the aggregate enhances recovery of the bitumen.

The use of carbon dioxide to aid in oil recovery is well known and such use can substantially increase the yield over other seondary and tertiary recovery techniques. This improvement in recovery can be as much as 50 to 100%. Several mechanisms have been postulated as contributing to the increased recovery. One major factor is a reduction in viscosity of the oil where the $CO_2$ is injected at sufficiently high pressure to make it soluble in the crude oil. For example, up to 700 scf of $CO_2$ will dissolve in 1 barrel of oil, reducing the viscosity of the oil from 10 to 100 times, depending on the initial apparent viscosity of the oil. The reduced viscosity results in a greater mobility of the oil to improve its recovery characteristics. In addition, the dissolved $CO_2$ will also produce a volume increase of 10 to 40 percent in the oil.

The present invention is well suited for using $CO_2$ in the bitumen recovery process. One of the difficulties in using $CO_2$ in the recovery process is the lack of a supply of $CO_2$ at the injection site. Importing the quantities of $CO_2$ needed to process large volumes of tar-sands is very expensive and is subject to fluctuations in the available supply. However, the present invention produces large quantities of $CO_2$ in-situ as a by-product which is immediately available at the production site. It should be apparent that the use of AC to produce hydrogen, carbon dioxide and other gases as hereinabove described, greatly increases the production techniques available to the reservoir engineer in obtaining maximum production from a given volume of mined tar-sand.

Laboratory experiments with bituminous coal have indicated that sulphur contained in the coal can be disassociated therefrom by the electrochemical action of the electrolyte and electrical current. Since the bitumen in tar-sands is not a "solid" as in coal, it is believed that, in addition to the other phenomena that occur as a result of the electro-chemical action of the current, electrolyte and heat, a large percentage of the sulphur present in the bitumen will be dissolved by the electrolyte during the process, thus acting to "de-sulphurize"the bitumen. Removing sulphur in the original recovery process would reduce the cost of later processing to remove sulphur, and would enhance the value of the bitumen, since sulphur present in coal, oil and bitumens is considered an ecological contaminant.

In summary, an earth aggregate comprising a naturally occurring material having a hydrocarbon constituent can be treated by establishing an AC electrical field within the aggregate generally defined by a plurality of spaced electrodes extending into the aggregate and by establishing in response to said electrical field a zone of electrochemical activity in the aggregate, the zone of electrochemical activity being generally defined by the electrical field and resulting in releasing the hydrocarbon constituents from the aggregate and in electrochemical reactions with constitutent elements of the aggregate and the hydrocarbon material for producing gases which react with the released hydrocarbon constituents to reduce the viscosity thereof and improve the flow characteristics of the fluid hydrocarbon constituents.

The shape of tank 10 can be any convenient shape such as rectangular tank 150 shown in FIG. 7, having side walls 152 constructed of material for providing electrical insulation from the earth and providing a space 154 for containing a predetermined volume of tar-sand aggregate and sized to accommodate a pair of electrodes 156 interconnected to a suitable power supply 157. Tank 150 could also be sized to accommodate four or other multiple of two, electrodes.

Similarly, tank 140 (see FIG. 6) could be sized with walls 142 to define a generally triangular space 144 to accommodate three electrodes 146, or spaced in a pentagonal form 160 (see FIG. 8) with side walls 162 to define a five-sided polygon space 164 for accommodating five electrodes 166. However, taking theoretical lines of current flow into account as will be hereinafter further described with respect to FIGS. 5 and 9, the shapes of such processing tanks could be modified to take such current fields into account.

Referring now to FIGS. 5, 6, 7 and 9, power distribution in the earth aggregate can be explained. In FIG. 5, assumed lines of current flow are illustrated for a two-electrode arrangement such as shown in FIG. 7. For simplicity all curves are assumed to be circles. Hence the lengths of the current paths can be calculated from measurements of the radii and angular lengths of arcs. Assuming the resistance to current flow is directly proportional to the length of the current path, then the power dissipated can be calculated as:

$$P=I^2R=(V^2/R) \quad (18)$$

where:

P is the power dissipated

I is the current

R is the resistance

V is the voltage impressed across the resistance

Substituting L (length of the current path) for R in equation (18):

$$P=(V^2/L) \quad (19)$$

the power at each circular arc relative to that along the direct line X between electrodes can be calculated.

Calculations show that greater than 50% of the power due to the current flow will be dissipated in a circle whose diameter is equal to the distance between the centers of the two electrodes, as can be seen in the circle shown at A in FIG. 5, thus causing a zone within circle A of great electrochemical activity, as hereinabove described in detail, reacting with the salt water, bitumen and other constituent elements of the earth aggregate. Of course, a great amount of power will be dissipated in the material outside of circle A, and, correspondingly, electrochemical reactions are also taking place in this greater zone.

Figure 2:
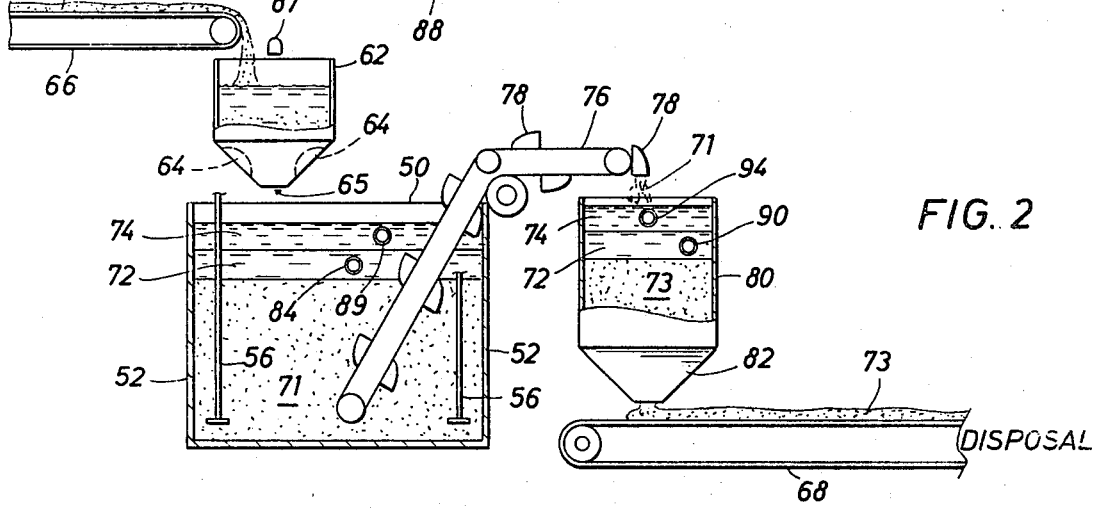
FIG. 2 is a cross-sectional view of the embodiment depicted in FIG. 1.

Referring to FIG. 9, a triangular spacing of electrodes is shown as in FIG. 2, with the application of three-phase AC current to the three electrodes 136, 137 and 138. Here three overlapping circles B, C and D are shown as the greater than 50% power dissipation zones between each of the three electrodes. As can be seen by reference to FIG. 5, the three-electrode, three-phase arrangement treats over twice the area that can be treated by installation of two electrodes. In addition, the overlapping zones of the power distribution circles may enhance the electrochemical activity in those areas, thereby enhancing the results obtained.

Accordingly, greater effects may result from the use of multiple electrode patterns that treat as large a volume of the aggregate as possible and practical. Increased spacing of the electrodes may enhance results, however, more power will probably be required to treat the aggregate volume as the separation between the electrodes increases and, of course, the tanks used to support the increased volume of aggregate must be larger and hence more costly.

As hereinbefore described, laboratory tests have revealed that AC current will cause the bitumen surrounding "water-wetted" sand to be released in a low viscosity state from the sand grains of a representative volume of the aggregate. Separation of the bitumen and water is caused by gravitational forces that will tend to force the low viscosity bitumen to rise in the test tank while water tends to be displaced to a level between the bitumen and the aggregate. It is believed that this same results can be achieved on a larger scale in a larger volume of the earth aggregate.

In the previous discussion, the electrolyte for carrying the AC current has been assumed to be the connate water film of a "water-wetted" sand. However, it may be necessary to add additional electrolyte to the mined tar-sand aggregate in order to achieve effective current paths and electrochemical action. Such additional electrolyte may be added by means of spray nozzles 35 receiving a selected electrolyte via pipe 37 from an electrolyte source (not shown).

In all of the foregoing embodiments herein described, it must be emphasized that the electrochemical effects and phenomilogical effects and phenomena occurring, based principally on the effects of AC disassociation of electrolyte water, are long-term residual effects and are not temporary in nature. While heat can decrease the apparent specific gravity and viscosity of the released bitumen, if the heat is eliminated or does not persist, the bitumen at ambient temperatures will retain its original viscosity and specific gravity. However, the electrochemical effects herein described permanently alter the chemical and physical properties of the treated bitumen, and, accordingly, the lowering of the viscosity and specific gravity, as hereinabove described in detail, are long term residual effects and benefits, even after the bitumen is withdrawn from the processing tank.

While the foregoing principally described the invention generally in terms of recovery of bitumens from a water-wetted earth aggregate and in particular from tar-sands, the invention admits to a much broader scope of application. It is contemplated that the basic gas generation processes and the electrochemical effects on hydrocarbon constituents of fossilized mineral fuels could be useful in the recovery of hydrocarbon components from non water-wetted earth aggregate, that is, aggregate that has no connate water associated with it.

For example, oil shale could be processed, utilizing the present invention by comminuting the shale prior to placement into the processing tank. However, since the oil shale is not "water wetted", a suitable electrolyte must be added as above described. Additionally, it may be desirable to subject the comminuted shale and electrolyte mixture to a selected pressure to force the electrolyte into the shale particles, thereby increasing the electrolyte density for a given volume of the comminuted shale.

Referring now to FIGS. 1 and 2, there may be seen an embodiment of the present invention particularly adapted to processing hydrocarbon bearing earth aggregate having little or no connate water associated therewith. The embodiment is shown to include a rectangular processing tank 50 having vertical walls 52 and a base 54 with a plurality of electrodes 56 positioned therein in accordance with the above-described method of operation. Each electrode 56 is shown connected by a conductor 58 to a source of electrical power 60.

As above-described, the effectiveness of the method has been found to be improved when employed in a three or more phase electrical configuration. Single-phase systems are operable and effective and the use of such system could be better adapted from an economic viewpoint if an electrical utility system is available in the area which involves difficulties of transportation and supply. However, a portable type generator producing three phase AC power and with appropriate transformer accessories is an obvious preference. It is well known that the three-phase generation of AC power may be had in either a "delta" or "Y" configuration, but the use of one or the other should be adapted in consideration of needs.

Employment of a uni-directional direct current system to accomplish a decomposition of the water and a separation of the hydrocarbons from the earth aggregate as well as the generation of heat is not to be ignored. While science declares that the water is divided into a proportional component parts (two hydrogen and one oxygen), large scale use of direct current could well generate large amounts of chlorine gas which is highly poisonous and corrosive. Further, it is not known whether all of the electrochemical effects above described can be achieved using DC current.

Direct current, however, may be employed in a manner that may be referred to as "alternating", whereby polarity is changed at predetermined time intervals to effect an "ionic wash" caused by mechanically changing the polarity of the various electrodes to cause such an effect sequentially between several current paths.

Still referring to FIGS. 1 and 2, the embodiment is shown to include a tar-sand aggregate feed hopper 62 having a feed hopper agitator assembly 64 suitably connected thereto. As above described, comminuted earth aggregate 70 is fed into hopper 62 by any conventional feed means such as the conveyor assembly 66 as shown. Again as above-described, much of the comminuted earth aggregate 70 will have little or no connate water associated therewith and, in order that the process may be most efficient, an electrolyte such as saline water stored in a water tank 86, is introduced into feed hopper 62 through pipe 87, where agitators 64 act to thoroughly mix the comminuted earth aggregate 70 and electrolyte. The mixture is then fed through a bottom opening 65 of hopper 62 into tank 50 and thereafter processed in accordance with the method above-described in connection with FIG. 3.

Although not shown, it may be found necessary for the efficiency of the process to pressurize the interior of tank 52 in order to increase the electrolyte density in contact with the comminuted earth aggregate. By injecting electrolyte into this pressurized interior, the electrolyte density may be increased, with the resulting increase in efficiency in the process.

As has been above-described, electrical current from power source 60 is introduced to the electrodes 56 via conductors 58, setting up the current paths through the aggregate/electrolyte mixture, necessary to disassociate the hydrocarbon component from the earth aggregate. The hydrocarbon component disassociated from the earth aggregate and the electrolyte tend to form stratas 74 and 72, respectively, above the earth aggregate due to gravitational action and the difference in specific gravity of the bitumen and electrolyte. The depleted earth aggregate may then be removed through use of any suitable means such as the transfer conveyor assembly 76 shown to include plurality of buckets 78. The bitumen from strata 74 may be removed by pump 88 through intake pipe 89 and delivered to a suitable storage or processing area (not shown). Similarly, electrolyte 72 may be removed from tank 50 by means of pump 85 and intake pipe 84 and delivered to an electrolyte treatment tank 87 through pipe 93 for processing the electrolyte prior to reuse. Treated electrolyte may then be transferred through pipe 95 to the electrolyte storage tank 86 for use in the system.

The remaining earth aggregate 71 removed by the transfer conveyor assembly 76 is deposited into a centrifuge assembly 80 which further acts to remove released hydrocarbon components or bitumen and electrolyte from the earth aggregate or sand 73. The earth aggregate 73 is then deposited through a bottom opening in the centrifuge assembly onto a discharge conveyor assembly 68 for disposal. The bitumen may be removed from centrifuge 80 by a pump 96 interposed in a pipe 94 communicating with the hydrocarbon stratum 74 in centrifuge assembly 80. The hydrocarbon component removed is pumped into a suitable storage container (not shown).

In a like manner, the electrolyte is recovered from its gravitational strata 72 by means of a pump 91 interposed in a pipe 90 communicating with electrolyte stratum 72 for transferring the electrolyte to treatment tank 87 as hereinabove described. It may be desirable to add make-up electrolyte solution to the storage tank 86 through pipe 92 connected to an additional source of electrolyte solution (not shown).

As has been above-described, quantities of gas are evolved by the AC electric current passing through the earth aggregate and electrolyte. Portions of the gas react with the released hydrocarbons to form different, lighter viscosity hydrocarbon compounds. However, in most instances, much more gas will be generated than is absorbed by the released hydrocarbon components or bitumen. It may be desirable to collect the gases thus evolved. Referring now to FIG. 10, there is shown a tank 98 having vertical walls 99 and a base 100 for retaining earth aggregate 44, including electrodes 101, all as has been above-described in the preferred embodiments. Additionally, a rigid or preferably a flexible cover 102 is positioned over tank 98 and sealed along the upper extremities of vertical walls 99. Further, electrodes 101, introduced into the sealed interior of tank 98 through cover 102 are sealed to the cover 102 at their point of passage therethrough. The evolved gases are removed through a pipe 103 communicating with the sealed interior of tank 98 and cover 102 at one extremity and connected at the other extremity to a pressure tank 105 (not shown). To assist in removing the evolved gases, a suction fan or pump 104 is interposed in pipe 103 between cover 102 and pressure tank 105. The gases thus evolved and not used in the recovery process may be stored for future use or may be separated into its various component gases using conventional methods (not shown). The gases may then be used in the further processing of the bitumen, for providing a source of fuel for heating or collected and sold for other uses. Of course, such a cover 102 may advantageously be used in connection with the previous embodiments above-described in connection with FIGS. 1, 2 and 3.

In the above discussion, it has been stated that the bitumen will gravitate to form a distinct strata at the surface of the water. However, not all the bitumen may separate from the sand and therefore it may be desirable to further process the sand by passing it through conventional de-sanding cones 170 as shown in FIGS. 2 and 10. Sand 44 is drawn from the tank by pump 172 interposed in a conduit 174 and discharged into the interior of the conventional de-sanding cones 170, with the cleaned sand 44 being ejected from the bottom and the connate water, bitumen and fuels carried thereby discharged through conduit 176 for storage or further processing.

In addition to the above-disclosed embodiments, various other means of introducing the earth aggregate 44 to a processing tank may be utilized. In FIG. 11, a continuous conveyor system 115 transports the earth aggregate material 44 from a conveyor hopper 114 slowly across the length of a tank 110 having vertical walls 111 and a base 112 containing an electrolyte 46. As in all other embodiments, a plurality of electrodes 113 are positioned within the interior of tank 110. As the earth aggregate 44 is moved slowly across the interior of tank 110 through the electrolyte bath 46, an electrical current is passed through the material to release the hydrocarbon components contained therein as hereinabove described. Again, as hereinabove earlier described, electrolyte and hydrocarbon components would be separated from the earth aggregate and gravitate to the upper levels of the tank 110 for conventional removal and processing. In order to prevent the bituminous components 48 from being drawn out of the tank 110 during removal of the sand 44 by conveyor 115, a shroud 180 is positioned around the discharge extremity of conveyor 115. Shroud 180 is positioned to extend into the electrolyte strata below the bitumen or hydrocarbon strata, (see FIG. 12). While allowing a pool of electrolyte 46 to form around the conveyor 115, shroud 180 prevents the hydrocarbon strata 48 from contacting the conveyor 115 and being removed from the tank 110 along with the sand 44. Sand 44 can then be conveniently removed by transport means such as conveyor 115. Tank 110 could be fitted with a cover 102 as shown in FIG. 10 to trap and collect all evolved gases.

Numerous variations and modifications may be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. Apparatus for recovering the bitumen component of a mined earth aggregate including a naturally occurring electrolyte dispersed therein, retaining means for receiving and retaining a preselected volume of the mined earth aggregate containing the bitumen and an electrolyte dispersed therein, said retaining means further providing electrical insulation for the mined earth aggregate from substantially all other earth (formation) materials adjacent thereto, a plurality of electrodes inserted into said mined earth aggregate and in electrical contact with said electrolyte dispersed therein, an AC electrical current source interconnected to each of said electrodes for establishing an AC current flow through said electrolyte for electrochemically breaking the molecular bond of the bitumen and electrolyte from the earth aggregate and releasing the bitumen and electrolyte therefrom in a liquid form, recovering means cooperating with the upper levels of said retaining means for recovering said released bitumen in a liquid form from said retaining means, means for removing said released electrolyte from said retaining means, and means for removing the remaining earth aggregate material from said retaining means from the bottom of said retaining means.

2. The apparatus disclosed in claim 1, wherein said retaining means further provides a liquid impervious barrier surrounding said preselected volume of the mined earth aggregate to prevent migration of said electrolyte and released bitumen from within said retaining means.

3. The apparatus disclosed in claim 2, wherein said AC electrical current source establishes a current flow through said electrolyte for elevating the temperature of said released bitumen to reduce the viscosity thereof to a fluid state, said elevation in temperature further aiding in releasing the bitumen from said earth aggregate.

4. The apparatus disclosed in claim 2, wherein said mined earth aggregate comprise a water-wetted tar sand having a film of connate saline water which acts as said electrolyte dispersed therein.

5. The apparatus described in claim 2, further including a source of a selected electrolyte, and means for introducing said electrolyte into said volume of the earth aggregate for enhancing said current flow established therein.

6. The apparatus as described in claim 5, wherein said electrolyte is selected to have a specific gravity greater than the specific gravity of said released bitumen.

7. The apparatus as described in claim 6, wherein said electrolyte is a saline fluid.

8. The apparatus disclosed in claim 6, wherein said bitumen in said fluid state and said electrolyte form discrete strata due to gravitational action and differences in specific gravity, and wherein said recovering means for recovering said released bitumen includes a pump for withdrawing said released bitumen from said discrete strata.

9. The apparatus described in claim 2, further including reduction means for comminuting the mined earth aggregate containing the bitumen component (for use as said) prior to introducing the earth aggregate into said retaining means, a source of electrolyte, and means for transferring said electrolyte from said source into said volume of said comminuted earth aggregate introduced into said retaining means for dispersion therethrough prior to establishing said current flow through said electrolyte.

10. The apparatus as described in claim 9, wherein said electrolyte is selected to have a specific gravity greater than the specific gravity of said released bitumen.

11. The apparatus as described in claim 10, wherein said electrolyte is a saline fluid.

12. The apparatus disclosed in claim 11, wherein said AC electrical current source establishes a current flow through said electrolyte for elevating the temperature of said released bitumen to reduce the viscosity of said released bitumen to a fluid state, said elevation in temperature further aiding in releasing the bitumen from said comminuted earth aggregate.

13. The apparatus disclosed in claim 12, wherein said bitumen in said fluid state and said electrolyte form discrete strata due to gravitational action and differences in specific gravity, and wherein said recovering means for recovering said released bitumen includes a pump for withdrawing said released bitumen from said discrete stratum.

14. The apparatus described in claim 9, further including sealing means cooperating with said retaining means for hermetically sealing said retaining means subsequent to said transfer of said electrolyte from said source into said preselected volume of said comminuted earth aggregate, and pressurizing means cooperating with said retaining means for increasing the pressure on said mixture of electrolyte and comminuted earth aggregate within said hermetically sealed retaining means for increasing the density of said electrolyte dispersed in said comminuted earth aggregate.

15. The apparatus described in claim 10, further including means disposed in said retaining means for agitating said comminuted earth aggregate and electrolyte mixture.

16. The apparatus disclosed in claim 9, wherein said AC electrical current source establishes a current flow through said electrolyte having a current density sufficient to generate free hydrogen gas due to electrically induced disassociation of said electrolyte for enriching said released bitumen by absorption of said free hydrogen.

17. The apparatus disclosed in claim 16, wherein said AC electrical current source establishes a current flow through said electrolyte and released bitumen having a current density sufficient for generating carbon dioxide and hydrocarbon gases due to electrically induced disassociation of said electrolyte and electrochemical reactions with said bitumen for enriching said released bitumen by absorption of said carbon dioxide and hydrocarbon gases.

18. The apparatus described in claim 17, further including collection means cooperating with said retaining means for removing excess free gases not absorbed by said bitumen from said retaining means and thereafter receiving and storing said removed free gases.

19. The apparatus disclosed in claim 9, wherein said source of AC electrical current is a source of single-phase AC electrical current.

20. The apparatus disclosed in claim 9, wherein the number of electrodes is three and said source of AC electrical current is a source of three-phase AC electrical current, one phase of which is connected to each of said three electrodes.

21. The apparatus disclosed in claim 1, wherein said AC electrical current source establishes a current flow through said electrolyte having a current density sufficient to generate free hydrogen gas due to electrically induced disassociation of said electrolyte for enriching said released bitumen by absorption of said free hydrogen.

22. The apparatus disclosed in claim 21, wherein said AC electrical current source establishes a current flow through said electrolyte and released bitumen having a current density sufficient to generate carbon dioxide and hydrocarbon gases due to electrically induced disassociation of said electrolyte and electrochemical reactions with said bitumen for enriching said released bitumen by absorption of said carbon dioxide and hydrocarbon gases.

23. The apparatus described in claim 22, further including collection means cooperating with retaining means for removing excess free gases not absorbed by said bitumen from said retaining means and thereafter receiving and storing said removed free gases.

24. The apparatus disclosed in claim 1, wherein said source of AC electrical current is a source of single-phase AC electrical current.

25. The apparatus disclosed in claim 1, wherein the number of electrodes is three and said source of said AC electrical current is a source of three-phase AC electrical current, one phase of which is connected to each of said three electrodes.

26. The apparatus described in claim 1, further including means disposed in said retaining means for agitating said mined earth aggregate and electrolyte mixture.

* * * * *